US005205648A

United States Patent [19]

Fissenko

[11] Patent Number: 5,205,648

[45] Date of Patent: Apr. 27, 1993

[54] METHOD AND DEVICE FOR ACTING UPON FLUIDS BY MEANS OF A SHOCK WAVE

[75] Inventor: Vladimir V. Fissenko, Moscow, U.S.S.R.

[73] Assignee: Transsonic Uberschall-Anlagen GmbH, Munich, Fed. Rep. of Germany

[21] Appl. No.: 755,050

[22] Filed: Sep. 5, 1991

[30] Foreign Application Priority Data

Sep. 6, 1990 [BG] Bulgaria ..... 92 795

[51] Int. Cl.[5] ..... B01F 15/02; B01F 5/02

[52] U.S. Cl. ..... 366/177; 137/3; 366/348

[58] Field of Search ..... 366/348, 349, 108, 116, 366/124, 127, 600, 163, 150, 176, 177, 178, 183; 137/3, 889, 888, 896; 68/355

[56] References Cited

U.S. PATENT DOCUMENTS

| | | | |
|---|---|---|---|
| 3,200,764 | 8/1965 | Saunders, Jr. . | |
| 3,799,195 | 3/1974 | Hermans | 366/160 |
| 3,937,445 | 2/1976 | Agosta | 366/341 |
| 4,344,752 | 8/1982 | Gallagher | 137/888 |
| 4,569,635 | 2/1986 | Nicodemus . | |
| 4,634,559 | 1/1987 | Eckert | 137/3 |

FOREIGN PATENT DOCUMENTS

| | | |
|---|---|---|
| 2617736 | 7/1987 | France . |
| WO83/01210 | 4/1983 | PCT Int'l Appl. . |
| WO89/10184 | 11/1989 | PCT Int'l Appl. . |
| 503113 | 2/1976 | U.S.S.R. . |
| 1105698 | 7/1984 | U.S.S.R. . |
| 1281761 | 1/1987 | U.S.S.R. . |
| 898171 | 6/1962 | United Kingdom . |
| 1111723 | 5/1968 | United Kingdom . |

OTHER PUBLICATIONS

Compilation of articles "Lopatochnye mashiny i strujnye apparaty", 5th issue, Moscow, 1971, published by "Mashinostroenie", pp. 241-261.

M. E. Dejch "Gasodinamika dvukhfaznykh sred", Moscow, published by "Energoizdat", 1981, p. 443, formula 14.34.

G. N. Abramovich "Prikladnaya gasovaya dinamika", Moscow, 1953, published by "Gostekhizdat", pp. 157-166.

V. V. Fisenko "Szhimaemost' teplonositelya i effektivnost'raboty konturov zirkulyazii YAEU", Moscow, 1987, published by "Energoatomizdat".

A copy of a leaflet entitled "HelioJet Fixed Flow System—Instant High Pressure Hot Water For Industrial Cleaning"—Helios Research Corporation. (Undated).

European Search Report of parallel European appln. 91 115 027.4 dated Nov. 29, 1991. (3 pages).

*Primary Examiner*—Robert W. Jenkins

*Attorney, Agent, or Firm*—John F. A. Earley; John F. A. Earley, III

[57] ABSTRACT

A two-phase mixture of at least two fluids which is supplied with subsonic velocity through associated feed lines (4, 3) is accelerated to sound velocity by means of a nozzle (2). Upon the exit from the narrowest cross-sectional area (6) of the nozzle (2) the two-phase mixture is expanded in an expansion chamber (10) to supersonic velocity. The two-phase mixture expanded to supersonic velocity is thereafter brought to ambient pressure substantially as a one-phase mixture after flowing off through a diffuser passage (9) by means of a shock wave built up in an outlet channel (8). The outlet channel (8) has a constant cross-sectional area the hydraulic diameter of which is as great as the hydraulic diameter of the narrowest cross-sectional area (6) of the nozzle (2) or amounts to up to the three-fold of this hydraulic diameter. An outlet (11) provided with a relief valve (22) is connected to the expansion chamber (10). After termination of a starting operation a continuous operation appears with the shock wave being stably maintained in axial direction in the outlet channel. In this manner a good mixture of the fluids can be obtained because of the angular flow and the relative velocities of the fluids, by condensation during the transition in the two-phase condition as well as by boiling and vaporization in the range of the supersonic flow and following thereto in the shock wave because of its "shattering effect".

6 Claims, 2 Drawing Sheets

METHOD AND DEVICE FOR ACTING UPON FLUIDS BY MEANS OF A SHOCK WAVE

The invention relates to a method and a device for acting upon fluids by means of a shock wave.

Fluids are to be understood as being liquids, gases and vapours with or without solid particles dispersed therein.

According to WO 89/10184 it is known to inject into a steam flow flowing with supersonic velocity of 500 to 800 m/s at least one liquid component to be emulsified. In the aerosol formed in this way from steam and finest droplets of the component to be emulsified, which aerosol flows with supersonic velocity, a liquid passive component is introduced. The mixture of steam and the components formed thereby which flows with supersonic velocity related to the mixture, is brought to ambient pressure through a shock wave or shock front with complete condensation of existing steam.

The supersonic velocity is obtained by means of a Laval nozzle, to the outlet cross-sectional area of which an injection zone for the liquid component to be emulsified is connected downstream of which injection zone a diffuser-shaped channel is arranged. Spaced from the outlet cross-sectional area of this channel a mixing chamber is arranged which is connected with the channel through a housing into which a feed line for a passive component opens. The mixing chamber has a part converging in flow direction and facing the outlet opening of the chamber and the Laval nozzle. To the converging part a cylindrical part is joined communicating with a diverging part. The cross-sectional area of the outlet opening of the diffuser-shaped channel is as great as the cross-sectional area of the cylindrical part of the mixing chamber and can amount to up to twice the cross-sectional area.

The provision of steam flowing with 500 to 800 m/s is very expensive. Because of the pressure increase in the shock wave in the cylindrical part a good emulsification of the liquid component in the passive component can be obtained wherein simultaneously any existing steam is condensed, however, it is very difficult to stabilize the shock wave in its axial position, which influences a constant operation of the device and thus a continuous production of the emulsion.

It is the object of the invention to improve the method and the device of the above-mentioned kind such that a continuous and stable operation is possible.

According to the method of the invention this object is obtained in that a two-phase mixture of two fluids which is supplied with subsonic velocity is accelerated to sound velocity, that the two-phase mixture is expanded to supersonic velocity and in that the two-phase mixture accelerated by said expansion to supersonic velocity is brought to an end pressure through a shock wave substantially as a one-phase mixture, which end pressure corresponds to the respective ambient pressure.

It is advantageous that in a mixture consisting of at least two fluids at least a further fluid is introduced before the thus formed two-phase mixture is accelerated to its sound velocity.

Conveniently the static pressure $P_{ck}$ in the rear of the shock wave is adjusted such that it is greater than the static pressure $P_1$ in front of the shock wave and is less than the half of the sum of the static pressure $P_1$ in front of the shock wave and of the total pressure $P_0$ in the rear of the shock wave or is equal to the half of this sum.

A stable operation with constant flow rates of the fluids is guaranteed if the outer pressure or end pressure $P_{np}$ is greater than the static pressure $P_1$ in front of the shock wave but less than the static pressure $P_{ck}$, in the rear of the shock wave or is equal to this pressure $P_{ck}$ wherein within these pressure ranges the pressure of the two-phase mixture expanded to its supersonic velocity is not released.

The intensity of the shock wave and thereby its effect can be enhanced further if heat and/or mass is supplied to the still one-phase fluid mixture or already two-phase fluid mixture flowing with subsonic velocity before coming to its sound velocity. It is also possible, together with this aforementioned measure or without this measure, to remove heat and/or mass from the fluid mixture flowing with supersonic velocity.

The aforementioned object is also obtained by means of a device comprising a nozzle coaxially connected to a feed line for a mixture of at least two fluids, an expansion chamber downstream of the narrowest cross-sectional area at the outlet side of the nozzle, an outlet channel having a constant cross-sectional area and being connected to the expansion chamber, the hydraulic diameter of which constant cross-sectional area is as great as the hydraulic diameter of the narrowest cross-sectional area of the nozzle or amounts to up to the threefold of the hydraulic diameter of the narrowest cross-sectional area of the nozzle, and an outlet connected with the expansion chamber and provided with a relief valve.

Advantageously, a feed line for at least a further fluid can be provided directly upstream of the narrowest cross-sectional area of the nozzle.

It is convenient to arrange the outlet channel of the expansion chamber in a coaxial manner with regard to the nozzle.

In an advantageous embodiment the narrowest cross-sectional area of the nozzle at the outlet side is formed by a diaphragm.

Preferably, the opening pressure of the relief valve is adjustable.

With the method according to the invention by using the device according to the invention it is possible to achieve the desired fluid action substantially independent of changes of the outside pressure and end pressure, respectively, in a continuous and stable manner at an optimum of energy supply and without troubles in operation.

By means of having the shock wave acting upon the fluids it is possible to produce in accordance with the invention homogeneous finely dispersed mixtures with predetermined concentrations of the single components from a plurality of components.

It is further possible to make finely dispersed and homogeneous structures with highly developed activation surfaces, also structures which are difficult to be mixed, with automatic proportioning with high accuracy. Such structures include also the homogenization of milk and the production of full-cream milk substitute, the preparation of medicaments and cosmetics as well as the production and mixing of bioactive products, the production of stable emulsions of water and fuel, the production of lacquers, colours and adhesives, the transport of fluids through tube lines and vessles preventing forming of depositions, the enhancement of surface activity with guaranteed effectivity, the preparation of stable hydrogen emulsions, the building of effective cleaning systems because of a highly developed activation surface with combinable possibilities of use of the device.

Further, with the use of the device according to the invention, there is the possibility of degasing and gas saturation in chemical reactors and other special plants, degasification and saturation with the production of juices, alcohol-free beverages and bier, the introduction of ecologically harmless technologies allowing a complete utilization of heat energy and a reduction of smoke development with combustion processes with central heating systems.

The device according to the invention can also be used as a pump and/or heat exchanger, for instance as a condenser pump and a heating pump of the mixing type single or in series, for producing of principally new closed and ecologically harmless systems in the field of energetics, metallurgics, in the chemical and biological industry with complete exploitation of heat energy, as pumps for contaminated waste waters and liquids, which can include solid particles, in cooperation with washing and cleaning equipments for halls, tankers and ship hulls as well as in connection with water collecting systems, fire extinguishing systems and equipments of production sites under fire hazard as well as for extracting of explosive and toxic gases in sewages and storage reservoirs.

The device can also be used in power plants, in a series arrangement of several units as feed water pump and/or for preheating, wherein steam taken from intermediate stages of the turbine are supplied as fluid and as energy carrier in order to be able TO carry out the single steps of the method.

All these different uses are possible because of the phenomenon of an enhanced compression in homogenous two-phase flows wherein the sound velocity is lower not only in the liquid but also in the gases or vapors. This phenomenon allows to achieve supersonic effects with $M>1$ wherein M is the Mach number representing the compression capability of a flowing medium and corresponding to the ratio of flow speed of a fluid or fluid mixture and of the local sound velocity in this fluid or fluid mixture, which supersonic effects can be obtained with a very low energy apply. Usually, increase of the Mach number is obtained in conventional jets or turbines by increasing the flow verloctiy, i.e. by increasing the flow verocity of the fluid, which is the numerator of the Mach number ratio. With the device according to the invention a supersonic effect is obtained by lowering the supersonic speed with middle and at least low sound velocities in the denominator of the Mach ratio which is a few tenths of meters per second and sometimes in the order of one meter per second. This allows to reduce the expenditure of energy with achieving the supersonic effects compared with conventional plants in a multiple amount. The practical realization of this phenomenon of the enhanced compression capability of homogenous two-phase mixtures is obtained by means of a shock wave proportional to the square of the Mach number, as the ratio of the pressure at the rear of the shock wave and of the pressure in front of the shock wave is proportional to the square of the Mach number.

Further objects and advantages of the invention are described in the following taking into account the accompanying drawings.

Figure 1:
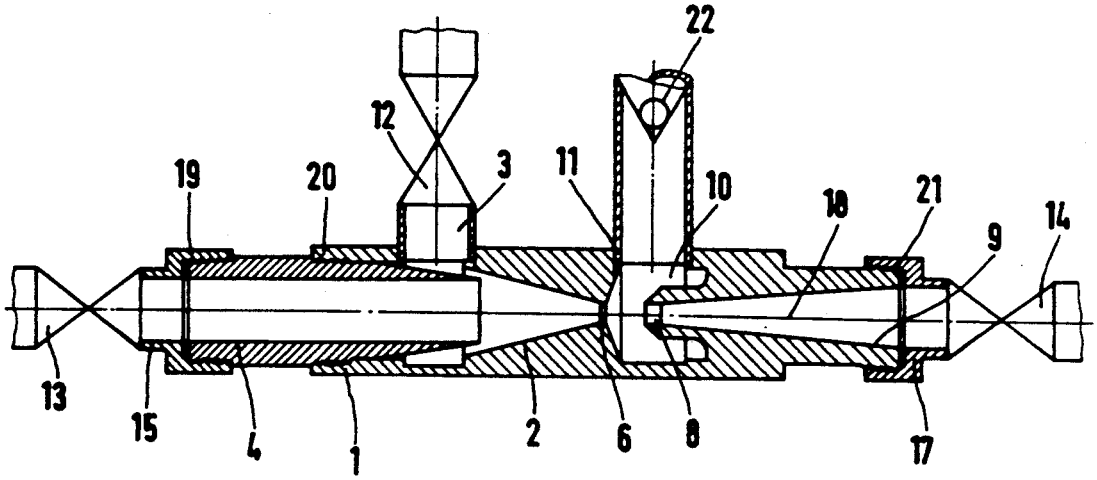
FIG. 1 is an axial section of a first embodiment of the device which is used for mixing fluids.

The device for acting upon fluids by means of a shock wave as shown in FIG. 1 which is used for producing homogeneous mixtures of fluids has a cylindrical housing 1 with inlet portion 20 in form of a substantial cylindrical bore on the one end side, which inlet portion 20 is joined by a conically tapering nozzle 2 ending in its narrowest cross-sectional area 6. The narrowest cross-sectional area 6 of the nozzle 2 is joined by a diffuser section of an expansion chamber 10. The cylindrical inlet section 20, the nozzle 2, its outlet cross-sectional area 6, the expansion chamber 10 and its diffuser portion are all disposed in rotational symmetry with regard to the cylindrical housing 1 and in coaxial arrangement in relation to its axis 18. This is also the case for the cylindrical outlet channel 8 arranged in the expansion chamber 10 opposite to the narrowest cross-sectional area 6 of the nozzle 2. The outlet channel 8 has a constant cross-sectional area with a diameter which is not allowed to be less than the narrowest cross-sectional area 6 of the nozzle 2, however, which is not allowed to exceed a diameter which is the threefold of the diameter of the narrowest cross-sectional area 6. A diffuser passage 9 is joined coaxially to the cylindrical outlet channel 8. On the outlet side of the diffuser passage 9 a cylindrical outlet socket 17 provided with a slide valve 14 is screwed by means of a threading connection 21 with the housing 1. The outlet socket 17 has a constant cross-sectional area with a diameter which corresponds to the outlet diameter of the diffuser passage 9.

A feed line 4 in form of a pipe section with constant cross-sectional area is fixed in the cylindrical inlet portion 20 of the housing 1. By means of a further threading connection 19 an inlet socket 15 provided with a slide valve 13 is screwed on the said pipe section. The cross-sectional area of the inlet socket 15 corresponds to that of the feed line 4. The feed line 4 and the inlet socket 15 are also arranged coaxially with regard to the axis 18. In the range of the end of the feed line 4 opposite to the inlet socket 15 a fluid feed line 3 provided with a slide valve 12 opens radially in the area of the beginning reduction of the cross-sectional area of the nozzle 2. An outlet socket 11 provided with a relief valve 22 which is biased in the direction towards the expansion chamber 10 opens radially into the expansion chamber 10.

The feed line 4 is axially adjustable with regard to the nozzle 2 through the threading connection at the inlet section 20 to the housing 1.

Figure 2:
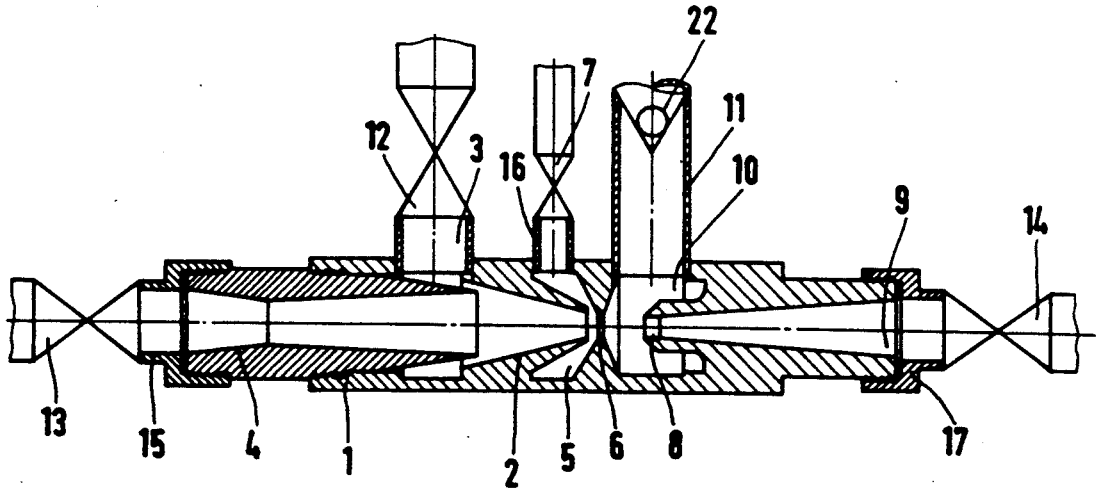
FIG. 2 is an axial section of a second embodiment of the device which is also used for mixing fluids.

With the embodiment of the device shown in FIG. 2 a feed line 4 with a cross-sectional area that is first converging and thereafter diverging is provided instead of the feed line 4 having a constant cross-sectional area. In front of its narrowest cross-sectional area on its outlet side which is with this embodiment defined as a diaphragm 6, the nozzle 2 comprises an interruption in circumferential direction which interruption is in communication with an angular chamber 5 into which annular chamber 5 a further inlet socket 16 for a fluid provided with a slide valve 7 opens radially.

Figure 4:
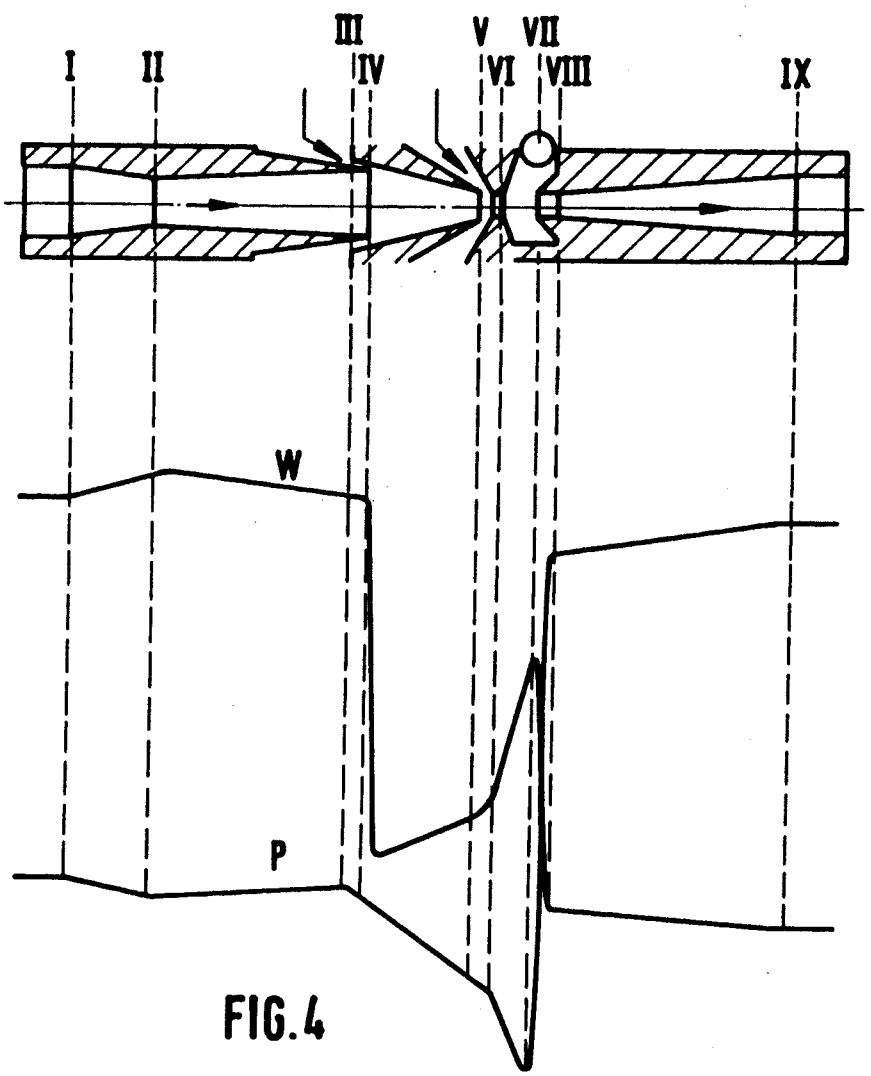
FIG. 4 shows diagrammatically the course of the flow velocity and of the static pressure of the fluid mixture in the axial direction of the device according to FIG. 2 in stable operation with closed relief valve.
Figure 3:
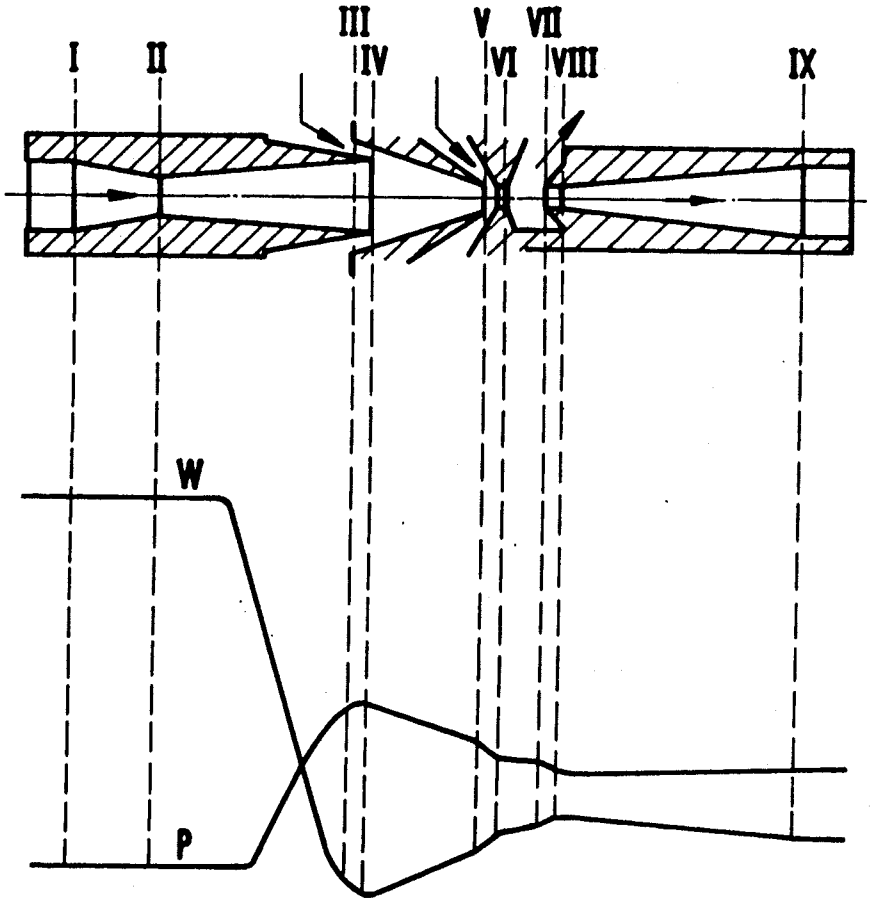
FIG. 3 shows diagrammatically the course of the flow velocity and of the static pressure of the fluid mixture in the axial direction of the device according to FIG. 2 in the starting period with opened relief valve.

Referring to the courses of the flow velocity W and the static pressure P of the fluid and the fluids and the fluid mixtures, respectively, as shown in FIG. 3 and 4, in the axial direction of the device according to FIG. 2 the starting period of the device and its stable operation, respectively, for the continuous production of the mixture are discussed in detail.

If the device is connected with a special desired plant, with the slide valves 7, 12, 13 and 14 being closed, the starting operation is initiated by opening the slide valves 7 and 12, whereby a first fluid is passed through the nozzle 2 and after mixing with a second fluid supplied through the inlet socket 16 is passed through the narrowest cross-sectional area in form of the diaphragm 6 and is further passed through the expansion chamber 10, the cylindrical outlet channel 8, the diffuser passage 9, the outlet socket 17 and the open slide valve 14. By opening the slide valve 13 a third fluid or fluid mixture is supplied through the inlet socket 15 and the feed line 4 in an axial flow into the nozzle 2 and is mixed with the first and the second fluid, which are supplied through the fluid feed line 3 and the inlet socket 16 in an angular flow around the fluid or fluid mixture introduced through the feed line 4. By the further fluid supply through the feed line 4 the pressure in the expansion chamber 10 is increased so far that the relief valve 22 in the outlet socket 11 opens whereby the mixture flows out through the outlet socket 11 and through the outlet channel 8 proportionally to their cross-sectional flow areas.

FIG. 3 and 4 show the device schematically, wherein I is the inlet cross section of the feed line 4 for the third fluid, II is the narrowed cross section of the feed line 4 for the third fluid and IV is the extended outlet cross section of the feed line 4 for the third fluid. The outlet cross section IV is surrounded by an angular inlet cross section III of the fluid feed line 3 for the first fluid, at which cross section III the nozzle 2 begins, which ends in the cross section V; which is surrounded by an angular inlet cross section of the inlet socket 16 for the second fluid. In the axial flow direction of the fluids and the fluid mixture, respectively, the narrowest cross section VI follows in form of the diaphragm 6, to which the expansion chamber 10 is joined which in turn is associated with the relief valve 22. To the expansion chamber 10 the outlet channel 8 is joined in the axial direction having an inlet cross section VII which is constant on a small predetermined length up to the cross section VIII and which enlarges therefrom in the form of the diffuser passage 9 up to the cross section IX of the outlet socket 17.

In FIG. 3 the state of the starting operation is shown, in which after opening of the slide valves 12 and 7 also the slide valves 13 and 14 are open and in which because of the pressure in the expansion chamber 10 also the relief valve 22 has opened. First the flow velocity W in the feed line 4 keeps substantially constant in spite of the reduction in cross section between the inlet cross section I and the narrowed cross section II. Because of the enlargement of the cross section and because of the mixing of the fluid the flow velocity decreases up to the outlet cross section IV. Because of the reduction of the cross section of the nozzle 2 the flow velocity W increases up to the narrowest cross section VI and still a little in the expansion chamber 10. Depending on the sizes of the channel cross sections the fluid mixture flows with corresponding flow rates through the outlet socket 11 and the outlet channel 8, the flow velocity W of the fluid mixture decreasing somewhat in the diffuser passage 9 up to the cross section of the outlet socket 17.

In the feed line 4 for the third fluid mixture the static pressure P is kept substantially constant up to the enlarged outlet cross section IV because of the axially downstream fluid admixtures although the cross-section changes. In the nozzle 2 the static pressure P decreases up to the cross section V of the end of the nozzle 2 and towards the narrowest cross section VI in form of the diaphragm 6. This is joined by a little pressure drop in the expansion chamber 10 and in the outlet channel 8 up to the cross section VIII, whereupon a small pressure increase follows in the diffuser passage 9 up to the cross section IX of the outlet socket 17.

In this state of the starting operation the pressure in the expansion chamber 10 begins to drop. The flow velocity in the narrowest cross section VI which has the form of the diaphragm 6 increases, while the pressure in the narrowest cross section VI decreases such that the pressure of the fluid components in form of vapour or gas falls below the saturation vapour pressure which results in the formation of a two-phase mixture—as far as a two-phase mixture was not formed already before by applying a liquid fluid—the sound velocity of which two-phase mixture being substantially lower than the sound velocity of the one-phase fluid mixture. Now the flow velocity increases in the nozzle 2 because of the reduction in cross section such that in the narrowest cross section VI of the diaphragm 6 finally the sound velocity of the two-phase mixture is obtained, which means that in the expansion chamber 10 the two-phase fluid mixture is accelerated to its supersonic velocity with a determined voluminal phase ratio.

Because of this a shock wave or shock front is built up in the cross section VII, i.e. in the beginning of the outlet channel 8, the strength of which is the greater the lower the static pressure P in the expansion chamber 10 and the greater the flow velocity W of the fluid mixture in the inlet of the outlet channel 8. The pressure drop in the expansion chamber 10 results on one side from discharging fluid mixture through the outlet socket 11, as the relief valve 22 has not yet or not yet completely closed, and on the other side from discharging the fluid mixture through the outlet channel 8 and the diffuser passage 9. Finally in the expansion chamber 10 that pressure is obtained at which the relief valve 22 closes. Now the device comes into the state of the continuous stable mixing operation according to FIG. 4.

The axial course of the flow velocity W of FIG. 4 shows the strong velocity drop during the admixture of the first fluid forming a two-phase mixture, wherein the velocity of the fluids at the beginning is in the subsonic area and the sound velocity related to the two-phase mixture is achieved in the narrowest cross section VI determined by the diaphragm 6. The flow velocity W between the cross sections VI and VII in the expansion chamber 10 with closed relief valve 22 is thereby in the supersonic area, however, wherein relation is made to the sound velocity of the two-phase fluid mixture which is substantially lower than the sound velocity of the corresponding one-phase mixture. According to the laws of gas dynamics between the cross sections VII and VIII an enormous local pressure increase appears upon a small axial length in form of a shock wave or shock front which holds its axial position constantly, wherein the ratio of the pressure directly downstream of the shock wave and the pressure in front of the shock wave can come up to a value of 100 or even 1000.

The fluid mixing of the fluids supplied at subsonic velocity through the feed line 4, the fluid feed line 3 and the inlet socket 16 is first based on the angular flows and the relative velocities. A further mixing results from condensation in the transfer to the two-phase condition, by boiling and vaporization in the area of the supersonic flows in the expansion chamber 10 and thereafter in the shock wave, where a "shattering effect" finally effects the resulting homogeneous structure of the mixture.

If during the stable operation of the device an excessive pressure increase should occur, this is compensated by a short-time opening of the correspondingly biased relief valve 22 without impairing the mixing operation and without changing the axial position of the shock wave.

The strength of the shock wave as well as the operatability of the device in the continuous mixing operation depends on the volume phase ratio in front of the shock wave. Depending on the requested quality of the fluid mixture the necessary volume phase ratio is adjusted in front of the shock wave by a corresponding selection of the proportion of the hydraulic diameters of the narrowest cross section of the nozzle 2 and the diaphragm 6, respectively, and of the hydraulic diameter of the outlet channel 8.

As can be seen from FIG. 4, the shock wave stands between the cross-sections VII and VIII. If the pressure in front of the shock wave is $P_1$ and at the rear of the shock wave is $P_2$, the pressure ratio of $P_2$ to $P_1$ is proportional to the square of the Mach number, as mentioned before. The making of a flow of a homogenous two-phase mixture of different fluids in front of the shock wave in cross-section VII (FIG. 4) is realized because of a geometric consumption and heat reaction on the flow in different zones in the flow direction of the device.

The use of the device for producing a homogenous mixture in form of an emulsion is to be explained in connection with the technology of the preparation of a milk substitute for calf breeding which also allows to demonstrate the capability of the device for transporting fluids.

Referring to the embodiment of the device according to FIG. 2 in connection with the graph of FIG. 4, steam is supplied through the feed line 4. Through the annular gap in the cross-section IV (FIG. 4) waste products from factories, producing milk, cream and butter, are added. These two fluids exchange their capacities of velocity and heat between the cross-sections IV and V, thereby reducing the pressure of the mixture and increasing the flow speed in the mixture, while the local sound speed of the mixture between the cross-sections V and VI (FIG. 4) is kept low. Additional fluids in form of fats and vitamins are introduced in the subsonic flow. In this zone of the device there is some expansion. As the latter mentioned fluids are fed in an atomized condition with mist-shaped structure they mix with the first mentioned two fluids while the speed of the mixture is increasing. Because of the law of "counter-action" the speed of the subsonic flow is increasing, if an additional mass is supplied through the diaphragm 6 (FIG. 2). The flow is further accelerated and the pressure drops further, thus, supersonic conditions belonging thereto are created because of the increase of the flow speed of the mixture and of the reduction of the sound velocity therein. Thus, between the cross-sections VI and VII in FIG. 4 the Mach number becomes a maximum with $M>1$. When the flow of mixture comes into the outlet channel 8 with constant cross-sectional area (FIG. 2) there is an extreme increase in pressure, as an uninterrupted transition through the sound velocity in the outlet channel 8 with a constant cross-sectional area is not possible. This extreme increase of pressure is the shock wave, and as mentioned, the pressure at the rear of the shock wave is increased in comparison with the pressure in front of the shock wave for the factor 100 to 1,000. Two-phase flow in front of the shock wave has a bubble-like or foam-like structure. As fat consits of surface-active particles a compact film is developed around each bubble of steam or gas. In the shock front the bubbles are disintegrated until disappearing, wherein the force of the specific pressure acting on the bubbles increases because of the reduced surface of the bubbles with a multiple factor. The bubbles disappear or implode on a very small space in a very short time increasing the effect for each bubble with a multiple factor. As a result the fat particles at the rear of the shock wave are disintegrated to a size of a micron or a tenth of a micron, which was not possible with any method or device by now.

The heat energy of the steam bubbles converted in the shock wave into mechanical work allows to realize the transport of products in automatic technologies, if the pressure at the rear of the shock wave adapts the resistance in the automatic device to the speed of the product therein. Thus, pumps usually inserted for this purpose are no more necessary.

A device according to the invention can be used in any case as a mixer, homogenisator, saturator and degassing equipment, however, with a means for transporting fluids and as a pump only if at least one of the fluids involved has a temperature that is higher than that of the other fluids or if the heat during mixing of the fluids results of an exothermic reaction in the fluids to be mixed, in other words, if a conversion of heat enerby into mechanical work is possible. In this case the total pressure of the components of the mixture at the outlet will be higher than the total pressure at the inlet.

An example for the use of the device as a pump combined with the heat exchanger is its mounting in a system with regenerative feed water preheaters in power plants using steam turbines as main power sources. For increasing the thermal effectivity in those plants the feed water is preheated stepwise, the feed water being passed from the condenser to the vessel by means of special pumps and being heated with special heat exchangers of the surface type with steam being taken partly from certain stages of the steam turbine. The use of the device according to the invention in systems with regenerative feed water preheaters allows to partly or totally dispense with surface heat exchangers and to partly or totally dispense with usually mounted electric pumps.

If the device is used as a heat exchanger pump as a stage of the regenerative preheater, steam is fed from a bleeder position at the turbine in the feed line 4 (FIG. 2), while water from the condenser or from a prestage of the regenerative preheater is introduced through an annular gap in the cross-section IV of FIG. 4 into the nozzle 2 acting as a conical mixing chamber. A first heat exchange and exchange of speed components between the fluids is carried out in the nozzle 2 simultaneously increasing the speed of the mixture and reducing the pressure therein. Between cross-section V and VI of FIG. 4 a liquid fluid is supplied with a temperature that is higher than the temperature of the liquid fluid in the cross-section IV, the purpose of use of this feeding being described later. There is a further accelaretion of the flow which prosecutes in the cross-section VI, the diaphragm 6 (of FIG. 2), and thereafter between the cross-section VI and VII of FIG. 4, where a flow speed is achieved which is higher than the sonic speed. Downstream of cross-section VII of FIG. 4 because of the before-mentioned reasons a shock wave is created. The heat of the supplied steam exceeds the water temperature at the outlet of the device. Simultaneously a part of the introduced heat is converted into working pressure such that the pressure of the hot water at the outlet is higher than the pressure of the steam and the water at the inlet. Part of the heated water of the outlet socket 17 (FIG. 2) is returned through the slide valve 7 and the inlet socket 16 (FIG. 2) between the cross-section V and VI (FIG. 4) which allows regulation of the temperature of the water at the outlet of the device and such increases effectiviy.

For explaining the function of the device as a heat exchanger reference is made to the above-mentioned geometric effects onto the flow, which allow to obtain between cross-section VI and VII (FIG. 4) a bubble-like or foam-like structure of the flow of the mixture, which bubbles have a very developed surface in heat exchange between the phases, which extremely increases the heat flow from the heating medium to the medium to be heated, which is always proportional to the temperature difference and the surface area. Enhancing of the latter allows production of great heat flows with low differences in temperature between the heated medium and the medium to be heated. All this leads not only to a reduction of the outer dimensions of the heat exchanger but also to an increase of efficiency, as the present heat is used contrary to existing heat exchangers. Summarizing it can be said that the developed surface of the phase sections (surface activity) enhances the flow activity of all exchange processes, independent whether this heat exchange is a mass exchange as described or a chemical or other process, in which the flow activity is dependent on the amount of the surface activity.

With regard to degassing fluids, it is known that the solubility of gases in liquids depends for selected components on temperature and pressure in the liquid. A pressure drop in the liquid allows always a reduction of the gas contents. The dependence on the temperature is more difficult but well known. By using these known dependencies, the contents of an undesired gas in the liquid can be reduced to the requested amount. For carrying out this process vapor of the liquid, which is to be degassed, or the liquid itself with a certain temperature in a certain rate is supplied through the feed line 4 (FIG. 2), while the same liquid is supplied through the slide valve 12 and the feed line 3 (FIG. 2) in the cross-section IV (FIG. 4). It is necessary that the temperature of the mixture has approximately 70° to 80° C., which corresponds with regard to each pressure to a minimum of solubility. The mixture with the said temperature accelerates in the conical nozzle 2 (FIG. 2) accompanied by simultaneously corresponding pressure drop. The mixture passes through the cross-section V (FIG. 4) while the pressure drops below the gas saturation point at the prevailing temperature. In front of the said cross-section a fluid is introduced into the flow of mixture, which fluid comes from the liquid at the outlet of the device. The flow of the two-phase mixture enters through the diaphragm 6 (FIG. 2) into the zone of the minimal pressure between the cross-section VI and VII (FIG. 4). Through the relief valve 22 (FIG. 2) a vapor-gas-mixture is discharged and passed into a special vacuum containment. The intensity and efficiency of degasification is controlled by means of the relief valve 22 (FIG. 2) which adjusts the pressure in the expansion chamber 10 acting as a vacuum chamber between the cross-sections VI and VII. By means of an overflow line connecting the outlet socket 17 (FIG. 2) with the chamber 10 between the cross-section V and VI (FIG. 4) through the slide valve 7 and the inlet socket 16 post-cleaning of the water, if necessary, can be carried out in form of a repeated passage between the cross-sections VI and VII. With this scheme a deaeration of feed water can be carried out before it is fed into the vessel. If necessary the device can simultaneously be used for degasing and as a feed pump for the vessel or for its first stage.

I claim:

1. Method for acting upon fluids by means of a shock wave, wherein a two-phase mixture comprising at least two fluids, which is supplied with subsonic velocity, is accelerated to its sound velocity, the two-phase mixture is expanded to its supersonic velocity and the two-phase mixture accelerated by said expansion to supersonic velocity is brought to an end pressure as a one-phase mixture by means of the shock wave.

2. Method according to claim 1, wherein at least a further fluid is introduced into the mixture of at least two fluids, before the two-phase mixture formed in such a manner is accelerated to its sound velocity.

3. Method according to claim 1, wherein the static pressure $P_{ck}$ at the rear of the shock wave is adjusted such that it is greater than the static pressure $P_1$ in front of the shock wave and is less than the half of the sum of the total pressure $P_0$ at the rear of the shock wave and of the static pressure $P_1$ in front of the shock wave or corresponds to that value.

4. Method according to claim 1, wherein the pressure of the two-phase mixture expanded to supersonic velocity is released, however, not as long as the end pressure $P_{np}$ is greater than the static pressure $P_1$ in front of the shock wave but less than the static pressure $P_{ck}$ at the rear of the shock wave or corresponds to this pressure $P_{ck}$.

5. Method according to claim 1, wherein heat and/or mass is supplied to the still one-phase mixture or already two-phase mixture flowing with subsonic verlocity before achieving its sound velocity.

6. Method according to claim 1, wherein heat and/or mass is removed from the fluid mixture flowing with supersonic velocity.

* * * * *